US006877248B1

(12) United States Patent
Cross et al.

(10) Patent No.: US 6,877,248 B1
(45) Date of Patent: Apr. 12, 2005

(54) CLOTHES DRYER WITH ULTRAVIOLET LIGHT

(76) Inventors: Gregory N. Cross, 102 Kahle St., Sistersville, WV (US) 26175; Tamela S. Cross, 102 Kahle St., Sistersville, WV (US) 26175

( * ) Notice: Subject to any disclaimer, the term of this patent is extended or adjusted under 35 U.S.C. 154(b) by 28 days.

(21) Appl. No.: 10/792,751

(22) Filed: Mar. 5, 2004

(51) Int. Cl.[7] ..... F26B 3/34

(52) U.S. Cl. ..... 34/275; 34/595; 34/596; 34/602

(58) Field of Search ..... 34/275, 60, 76, 34/130, 132, 595, 596, 602, 218, 224, 232, 233

(56) References Cited

U.S. PATENT DOCUMENTS 2,727,315 A * 12/1955 Candor ..... 34/543
2,742,708 A * 4/1956 McCormick ..... 34/76
4,057,907 A 11/1977 Rapino et al.
5,546,678 A 8/1996 Dhaemers
5,664,340 A 9/1997 Brown
5,724,750 A 3/1998 Burress
5,953,831 A 9/1999 Yu
6,088,932 A 7/2000 Adamski et al.
6,185,834 B1 * 2/2001 Yang ..... 34/58
6,393,725 B1 5/2002 Smith et al.
2003/0126691 A1 * 7/2003 Gerlach et al. ..... 8/158

* cited by examiner

*Primary Examiner*—Jiping Lu
(74) *Attorney, Agent, or Firm*—John D. Gugliotta

(57) ABSTRACT

A clothes dryer is provided which incorporates ultraviolet light sources to aid in the sterilization of the clothing as it is dried. A series of ultraviolet emitters, envisioned to be germicidal lamps, are located around the perimeter of the drying drum inside of the dryer. As the clothes dryer operates, these lamps are energized, and their light passed thru clear panels into the drying drum where they can aid in the killing of germs, bacteria and the like. Such a feature is envisioned as being particularly useful in hospitals, centers where biological studies are performed, or for those who are particularly susceptible to infectious diseases.

5 Claims, 4 Drawing Sheets

CLOTHES DRYER WITH ULTRAVIOLET LIGHT

RELATED APPLICATIONS

The present invention contains subject matter that was first described in Disclosure Document Registration 524, 106 filed on Jan. 6, 2003 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

There are no previously filed, nor currently any co-pending applications, anywhere in the world.

BACKGROUND OF THE INVENTION

1. Field of the Invention

The present invention relates generally to clothes dryers and, more particularly, to a clothes dryer with an integral ultraviolet light for purposes of reducing germs and bacteria.

2. Description of the Related Art

In recent society, there has been a trend toward increased sanitization of everyday objects and surfaces one tends to come in contact with. This trend is evidenced by a quick trip to a local store where one will find the shelves lined with antibacterial soap, hand lotion sanitizer, anti-bacterial surface cleaner, HEPA air filtration systems and the like. However, the one object that we all touch every day, our clothing, remains untouched by this trend. Even with the clothing being washed daily, small microorganisms, either picked up throughout the day, or even in the water used to wash the clothes, remain on the clothing and can lead to further disease transmission. This same problem exists for bed linens, towels and other textiles that one comes in contact with every day.

A search of the prior art did not disclose any patents that read directly on the claims of the instant invention; however, the following references were considered related:

U.S. Pat. No. 5,664,340 discloses an utraviolet, antibacterial, antifungal dryerlight.

U.S. Pat. No. 5,546,678 discloses an armoire adaptable to a sauna, drum dryer, and tubular lighted clothing dryer with humidity damper control of exhaust gases.

U.S. Pat. No. 6,393,725 discloses a compact microwave clothes dryer and method.

U.S. Pat. No. 5,953,831 discloses an infrared-radiating clothes dryer.

U.S. Pat. No. 5,724,750 discloses a clothes dryer with Peltier effect heating, infrared heating, and vacuum drying capabilities.

U.S. Pat. No. 4,057,907 discloses a method and apparatus for drying clothes.

And, U.S. Pat. No. 6,088,932 discloses an efficiency clothes dryer.

Consequently, a need has been felt for providing an apparatus and method of sanitizing clothes as they are dried.

SUMMARY OF THE INVENTION

It is therefore an object of the present invention to provide an improved clothes dryer.

It is a feature of the present invention to provide an adaptation of a conventional dryer in which UV radiation is permitted to sterilize the drum contents via a radiation source outside the drum.

Briefly described according to one embodiment of the present invention, a clothes dryer is provided which incorporates ultraviolet light sources to aid in the sterilization of the clothing as it is dried. A series of ultraviolet emitters, envisioned to be germicidal lamps, are located around the perimeter of the drying drum inside of the dryer. Similarly, ultraviolet emmitters can alternately or additionally be placed along the back of the clothes drum as well. As the clothes dryer operates, these lamps are energized, and their light is passed thru clear panels and/or perforated panels into the drying drum where they can aid in the killing of germs, bacteria and the like. Such a feature is envisioned as being particularly useful in hospitals, centers where biological studies are performed, or for those who are particularly susceptible to infectious diseases.

The use of the clothes dryer with ultraviolet light allows for the sterilization of clothing in a quick, easy and effective manner which does not take any extra time or processing beyond that normally required to dry clothes in a dryer.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 5.

1. Detailed Description of the Figures

Figure 1:
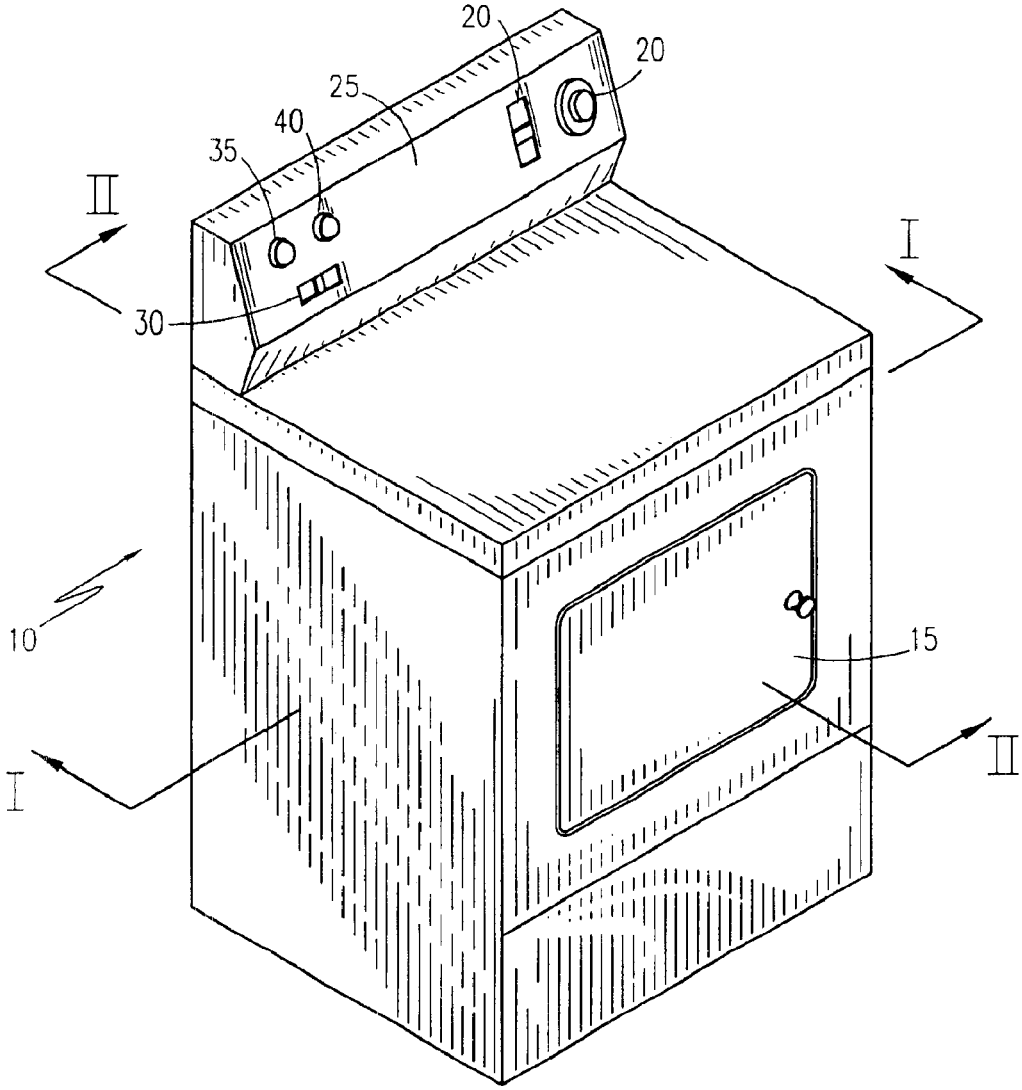
FIG. 1 is an isometric view of the clothes dryer with ultraviolet light 10, according to a preferred embodiment of the present invention.

Referring to FIG. 1, an isometric view of the clothes dryer with ultraviolet light 10, according to a preferred embodiment of the present invention is disclosed. It is envisioned that the clothes dryer with ultraviolet light 10 would be of the customary size and style associated with a conventional clothes dryer as found in a domestic residence. The clothes dryer with ultraviolet light 10 is equipped with an access door 15, for inserting and removing clothes, bed linens, towels and other fabric-based articles typically dried in a clothes dryer. The clothes dryer with ultraviolet light 10 is depicted as a front loading model for purposes of illustration, though it is not intended to be a limiting factor of the present invention. A plurality of conventional control circuitry 20 is provided on an upper panel face 25 of the clothes dryer with ultraviolet light 10. Also located on the upper panel face 25 is an ultraviolet light control switch 30 which provides ON and OFF control functionality over the sterilization process associated with the clothes dryer with ultraviolet light 10. In the ON position, ultraviolet light rays are applied to fabric articles located inside of the clothes dryer with ultraviolet light 10. This feature allows for the reduction of germs, bacteria and other living organisms that may be present on the fabric articles. In the OFF position, the ultraviolet light sources, which will be described in greater detail herein below, are de-energized, thus allowing the clothes dryer with ultraviolet light 10 to function as a conventional clothes dryer when drying fabric articles which do not require the reduction of germs, bacteria, and the like. Additionally, in the OFF position, the user will experience additional energy savings as well as increasing the life expectancy of the ultraviolet light sources. Located above the ultraviolet light control switch 30 is an operational indicator light 35 which provides operational indication of the ultraviolet light sources. Finally, an ultraviolet light source malfunction indicator light 40 provides indication to the user that one or more of the ultraviolet light sources, which will be described in greater detail herein below, are not operational and require repair or replacement.

Figure 2:
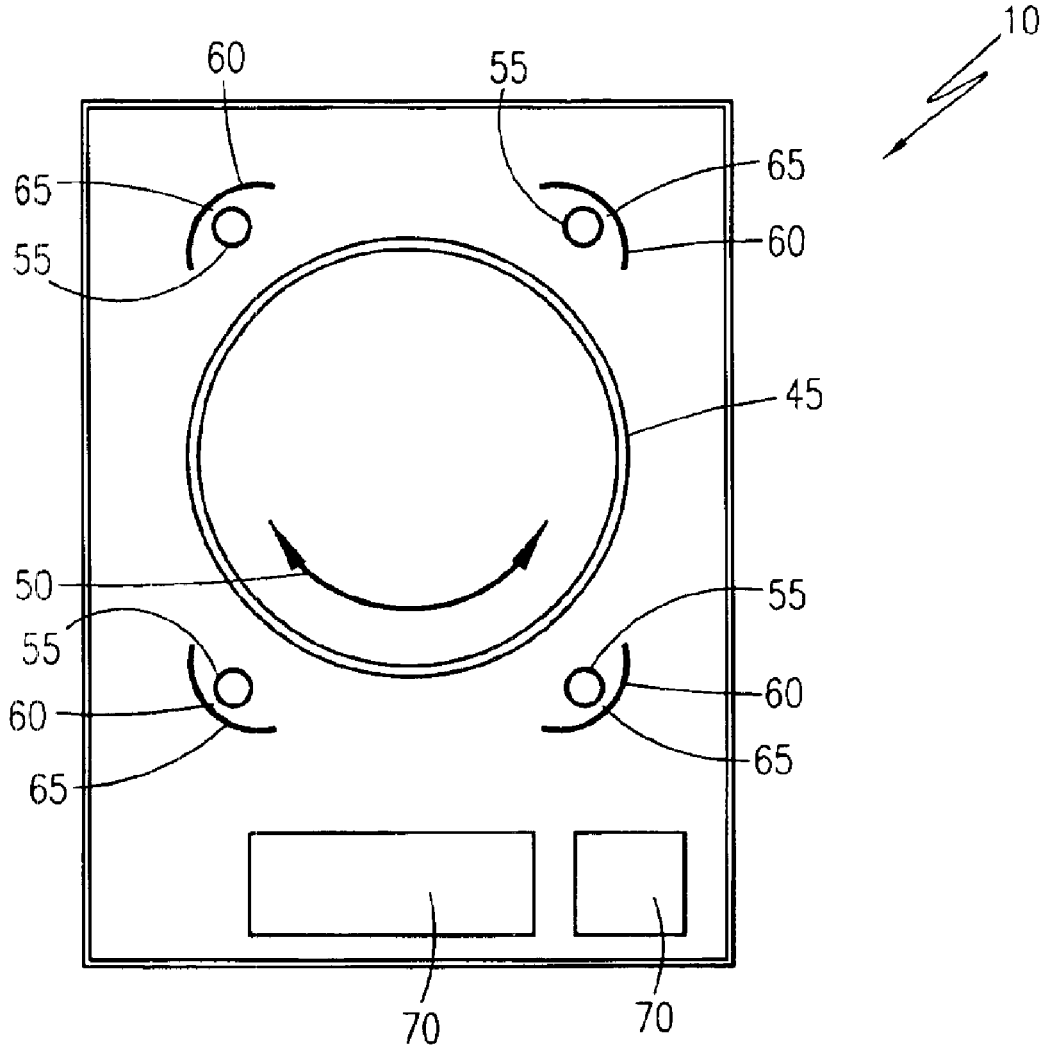
FIG. 2 is a sectional view of the clothes dryer with ultraviolet light 10, according to a preferred embodiment of the present invention, as taken along a line I—I as seen in FIG. 1.

Referring now to FIG. 2, a sectional view of the clothes dryer with ultraviolet light 10, according to a preferred embodiment of the present invention, as taken along a line I—I as seen in FIG. 1, is depicted. This FIG clearly depicts the view as seen along a surface perpendicular to a central axis of a rotating drying drum 45. The rotating drying drum 45 is accessed through the access door 15, as shown in FIG. 1. The rotating drying drum 45 rotates about a center axis as depicted by a first rotational direction arrow 50. Located around the perimeter of the rotating drying drum 45 are a series of sets of ultraviolet light source 55, reflector 60 and ultraviolet light detector 65. It is envisioned that placement of the ultraviolet light source 55 can alternately be made behind or along the rear of the rotating drying drum in order to provide an alternate design incorporating the teachings of the present invention. For the purposes of illustration, there are four sets shown in FIG. 2, but are not intended to be a limiting factor. A quantity of one set will provide the functionality of the clothes dryer with ultraviolet light 10, though additional sets, up to four and beyond, will provide increased coverage and a more thorough reduction of germs and bacteria. The ultraviolet light source 55 is envisioned to be of a fluorescent tube variety and positioned such that its central axis is parallel to the central axis of the rotating drying drum 45. The reflector 60 is of a partial cylindrical shape whose axis is also parallel to the ultraviolet light source 55 and rotating drying drum 45. An ultraviolet light detector 65, designed to produce an electrical signal in the presence of ultraviolet radiation, is positioned between the ultraviolet light source 55 and the reflector 60. The ultraviolet light detector 65 will be described in greater detail herein below, and will serve to indicate to the user that one or more of the ultraviolet light source 55 are nonoperational. Located below the rotating drying drum 45 is a conventional drying mechanism 70 envisioned to be of either the gas or electric variety, or other conventional or novel drying means such as infrared, microwave, or the like. The functionality provided via the ultraviolet light source 55 will be provided with dryers operating on electric or gas, and as such, should not be interpreted as a limiting factor of the present invention.

Figure 3:
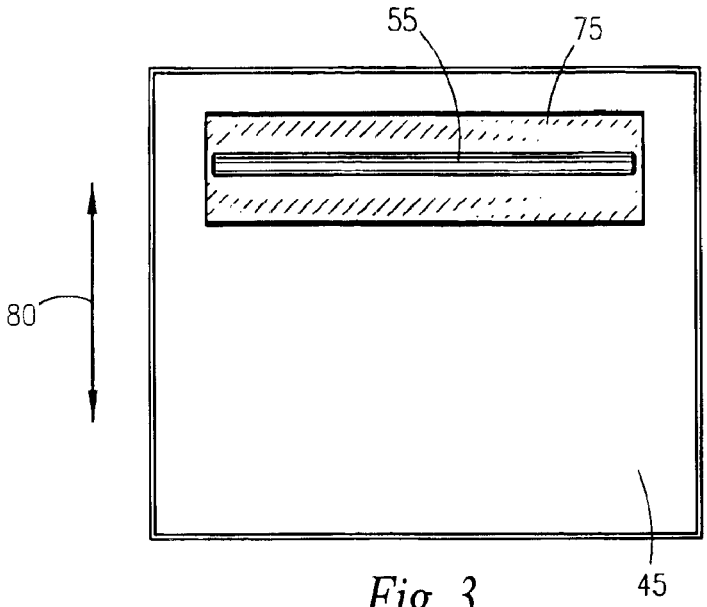
FIG. 3 is a sectional view of the clothes dryer with ultraviolet light 10, according to a preferred embodiment of the present invention, as taken along a line II—II as seen in FIG. 1.

Referring next to FIG. 3, a sectional view of the clothes dryer with ultraviolet light 10, according to a preferred embodiment of the present invention, as taken along a line II—II as seen in FIG. 1, is depicted. This FIG clearly depicts the view as seen along a surface parallel to the central axis of the rotating drying drum 45. A clear window 75, envisioned to be made of tempered glass, Plexiglas®, Lexan®, or other material which will allow ultraviolet radiation to pass through, is provided in the exterior perimeter of the rotating drying drum 45. Visible behind the clear window 75 is one of the ultraviolet light source 55. As the drum rotates in a direction as indicated by a second rotational directional arrow 80, the clear window 75 will pass by the ultraviolet light source 55, which is stationary. It should be noted that the clear window 75 will pass by multiple ultraviolet light source 55 in the case of more than one ultraviolet light source 55 as shown by the example of four in FIG. 2. In such a manner, the ultraviolet radiation is allowed free access to the interior of the rotating drying drum 45 while still containing the fabric-based articles contained within.

Figure 4:
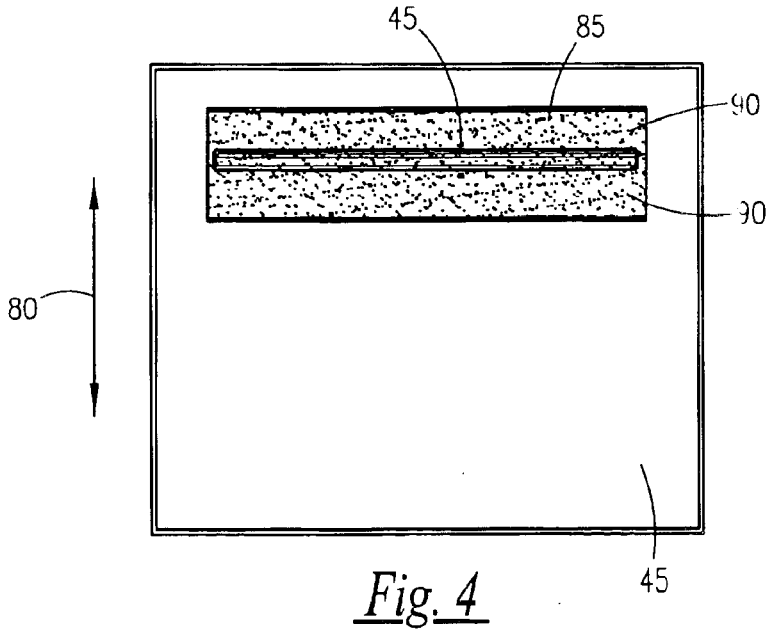
FIG. 4 is a sectional view of the clothes dryer with ultraviolet light 10, according to an alternate embodiment of the present invention, as taken along a line II—II as seen in FIG. 1.

Referring next to FIG. 4, a sectional view of the clothes dryer with ultraviolet light 10, according to an alternate embodiment of the present invention, as taken along a line II—II as seen in FIG. 1, is depicted. This FIG clearly depicts the view as seen along a surface parallel to the central axis of the rotating drying drum 45. A perforated openings 85 is provided in the exterior perimeter of the rotating drying drum 45. Said perforated opening 85 utilizes individual openings 90 of a sufficient diameter to allow ultraviolet light to pass unrestricted, yet are small enough to contain the fabric-based articles inside of the rotating drying drum 45. Visible behind the perforated openings 85 is one of the ultraviolet light source 55. As the drum rotates in a direction as indicated by the second rotational directional arrow 80, the perforated openings 85 will pass by the ultraviolet light source 55, which is stationary. It should be noted that the perforated opening 85 will pass by multiple ultraviolet light source 55 in the case of more than one ultraviolet light source 55 as shown by the example of four in FIG. 2. In such a manner, the ultraviolet radiation is allowed free access to the interior of the rotating drying drum 45 while still containing the fabric-based articles contained within.

Figure 5:
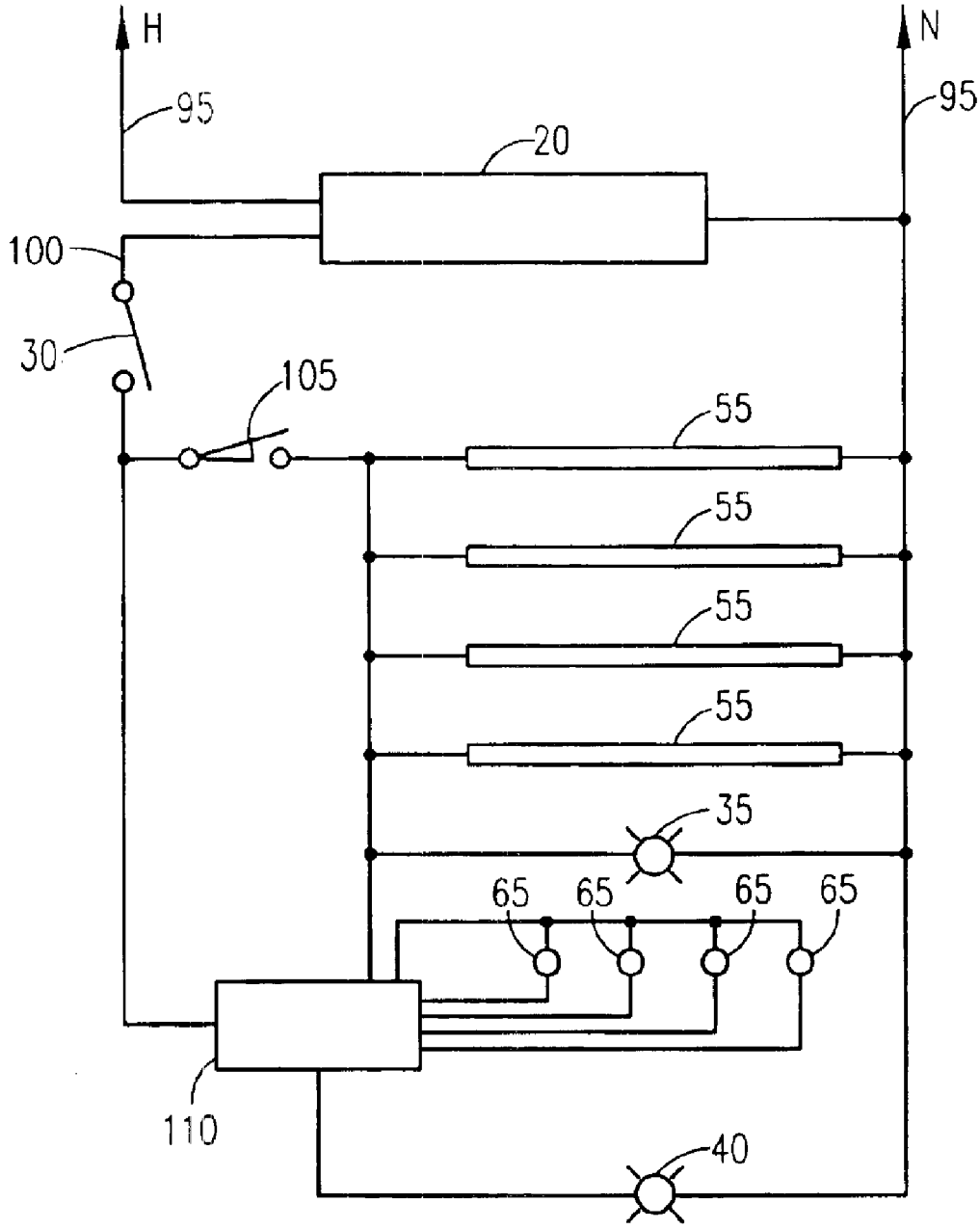
FIG. 5 is an electrical schematic of the circuitry.

Referring finally to FIG. 5, an electrical schematic of the circuitry associated with the clothes dryer with ultraviolet light 10 is disclosed. Electrical power is provided by a line voltage 95 as customarily and usually provided as part of a conventional clothes dryer. The line voltage 95 enters the conventional control circuitry 20 which is well known in the art. An output signal 100 is provided from the conventional control circuitry 20 which is energized and provides operating current whenever the rotating drying drum 45, as shown in FIGS. 2, 3, and 4, is operational and rotating. Thus, when the conventional control circuitry 20 completes the drying cycle, the output signal 100 is also de-energized thus removing power from the ultraviolet light source 55. The output signal 100 is then routed through the ultraviolet light control switch 30, which allows user control of whether or not the ultraviolet light source 55 should be operated. As aforementioned described, there may be occasions upon which the user does not desire the operation of the ultraviolet light source 55. The output of the ultraviolet light control switch 30 is then routed through a door interlock switch 105, which opens the circuit whenever the access door 15, as shown in FIG. 1, is opened. In such a manner, the user is protected from inadvertent exposure to ultraviolet radiation if the access door 15 is left open prior to activation, or opened during activation. At this point, electrical power is then applied to the series of ultraviolet light sources 55 in a parallel circuit arrangement as shown. Power is likewise applied to the operational indicator light 35 to indicate operation. Electrical power from both sides of the door interlock switch 105 are applied to an ultraviolet sensor circuit 110, which relies on input signals from the ultraviolet light detectors 65, of which one is provided for every ultraviolet light source 55. If the ultraviolet sensor circuit 110 detects operation of the circuitry as provided by the permissives supplied by the conventional control circuitry 20, the ultraviolet light control switch 30 and the door interlock switch 105, yet no corresponding ultraviolet signature is detected by the ultraviolet light detector 65, the ultraviolet sensor circuit 110 will supply an output signal to the ultraviolet light source malfunction indicator light 40 as aforementioned described in FIG. 1. It is envisioned that the conventional control circuitry 20 would provide a flashing signal to the ultraviolet light source malfunction indicator light 40 to indicate the non-operational ultraviolet light detector 65. (i.e., two flashes in a row would indicate the second ultraviolet light source 55 is non operational, while four flashes would indicate the fourth ultraviolet light source 55, and so on and so forth).

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The preferred embodiment of the present invention can be utilized by the common user in a simple and effortless manner with little or no training. While the features and the benefits associated with the clothes dryer with ultraviolet light 10 could be adapted for use with existing clothes dryers, it is envisioned that they would be most likely enjoyed as an integral part of a new clothes dryer. After the clothes dryer with ultraviolet light 10 is purchased, it would be installed like a conventional clothes dryer, thus requiring a connection to an electrical supply, perhaps a natural gas supply and an exhaust system. After such installation and verification, the clothes dryer with ultraviolet light 10 is ready for use.

To use the present invention, the user would load wet or damp fabric-based items into the rotating drying drum 45 of the clothes dryer with ultraviolet light 10 through the access door 15. Said items are envisioned to be clothing, bed linens, bath towels, and similar items typically cleaned and dried in a conventional washer and dryer set. After loading, the user would select the appropriate drying time and drying settings on the conventional control circuitry 20. The operation of the rotating drying drum 45 initially places the ultraviolet light control switch 30 in its default, ON position. Should operation not be desired, the ultraviolet light control switch 30 would be placed in the OFF position. At this point, the drying cycle would commence and drying of the fabric-based items would begin, with sterilization being provided by the ultraviolet light source 55 should it be desired. Operation of the ultraviolet light source 55 is verified by the operational indicator light 35. Should the ultraviolet light source malfunction indicator light 40 be illuminated or flashing, the user is alerted to a non-operational ultraviolet light source 55 inside of the clothes dryer with ultraviolet light 10, and corrective measures such as repair or replacement would be taken. After operation, which takes no more or less time that a conventional clothes dryer, the items are removed, and the clothes dryer with ultraviolet light 10 is then ready to repeat this cycle as needed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. In a clothes dryer as found in a domestic residence equipped with an access door, a rotating drying drum accessed through said access door, said rotating drying drum rotatable about a center axis, the improvement comprising:

an ultraviolet light;

a plurality of conventional control circuitry provided on an upper panel face, said control circuitry including an ultraviolet light control switch which provides ON and OFF control functionality over the sterilization process associated with the clothes dryer with ultraviolet light;

wherein when said control switch is on the ON position, ultraviolet light rays are applied to fabric articles located inside of the clothes dryer with ultraviolet light;

a series of reflectors located around a perimeter of the rotating drying drum;

a series of sets of ultraviolet light sources, each positioned such that its central axis is parallel to the central axis of the rotating drying drum; and an ultraviolet light detector designed to produce an electrical signal in the presence of ultraviolet radiation, said detector positioned between the ultraviolet light source and the reflector.

2. In the clothes dryer of claim 1, wherein the improvement further comprises:

clear window which will allow ultraviolet radiation to pass through, provided in the exterior perimeter of the rotating drying drum.

3. In the clothes dryer of claim 2, wherein the improvement further comprises:

a perforated opening formed by the exterior perimeter of the rotating drying drum, said perforated opening utilizing individual openings of a sufficient diameter to allow ultraviolet light to pass unrestricted, yet are small enough to contain the fabric-based articles inside of the rotating drying drum.

4. The clothes dryer of claim 1, wherein each said reflector is of a partial cylindrical shape whose axis is also parallel to the ultraviolet light source and rotating drying drum.

5. In the clothes dryer of claim 1, having a rotating drying drum accessed through said access door, said rotating drying drum rotatable about a center axis, wherein said improvement further comprises:

a series of reflectors located along the rear of the rotating drying drum;

a series of sets of ultraviolet light sources, each positioned such that its central axis is parallel to the face of the rear of the rotating drying drum.

* * * * *